US012428701B2

(12) United States Patent
Panza-Giosa et al.

(10) Patent No.: US 12,428,701 B2
(45) Date of Patent: Sep. 30, 2025

(54) METHOD FOR INCREASING THE ULTIMATE TENSILE STRESS (UTS) AND YIELD STRENGTH (YS) OF HIGH-STRENGTH MARTENSITIC STEELS

(71) Applicant: GOODRICH CORPORATION, Charlotte, NC (US)

(72) Inventors: Roque Panza-Giosa, Oakville (CA); Paul Vanderpol, Rockwood (CA)

(73) Assignee: GOODRICH CORPORATION, Charlotte, NC (US)

( * ) Notice: Subject to any disclaimer, the term of this patent is extended or adjusted under 35 U.S.C. 154(b) by 12 days.

(21) Appl. No.: 18/165,861

(22) Filed: Feb. 7, 2023

(65) Prior Publication Data

US 2024/0263266 A1 Aug. 8, 2024

(51) Int. Cl.

*C21D 11/00* (2006.01)
*C21D 1/18* (2006.01)
*C21D 1/84* (2006.01)

(52) U.S. Cl.

CPC ..... *C21D 11/005* (2013.01); *C21D 1/18* (2013.01); *C21D 1/84* (2013.01)

(58) Field of Classification Search

CPC ..... C21D 11/005; C21D 1/18; C21D 1/185; C21D 1/19; C21D 1/613; C21D 1/62; C21D 1/74; C21D 1/76; C21D 1/763; C21D 1/767; C21D 1/773; C21D 1/56; C21D 1/58; C21D 9/00; C21D 9/0062

See application file for complete search history.

(56) References Cited

U.S. PATENT DOCUMENTS 5,268,044 A 12/1993 Hemphill et al.
5,866,066 A 2/1999 Hemphill et al.
7,967,927 B2 6/2011 Kuehmann et al.
(Continued)

FOREIGN PATENT DOCUMENTS

CN 113416818 9/2021
CN 113999962 2/2022
KR 100657560 B1 * 12/2006 ..... C21D 9/00

OTHER PUBLICATIONS

Bates, Charles E.; Totten, George E.; Brennan, Robert L., "Quenching of Steel," vol. 4: Heat Treating, ASM Handbooks Online, ASM International, 73 pages, 2002. (Year: 2002).*
(Continued)

*Primary Examiner* — Vanessa T. Luk
(74) *Attorney, Agent, or Firm* — SNELL & WILMER L.L.P.

(57) ABSTRACT

A method of implementing a heat treatment process for enhancing strength of a part is provided. The method includes applying, by a controller, a gas quenching process to enable a controlled operation for cooling the part wherein the part comprises a steel material wherein the controlled operation for cooling the part is a subsequent action in the heat treatment process applied after the steel material of the part has been heated to a critical temperature. Also, controlling, by the controller, the cooling of the steel material of the part in the gas quenching process by affecting of changes in a cooling rate over one or more increments of time for the cooling of the part that results in at least an increase in value of an Ultimate Tensile Strength (UTS) of the steel material in correspondence with a decrease in the cooling rate by the controller.

10 Claims, 11 Drawing Sheets

(56) References Cited

U.S. PATENT DOCUMENTS

| | | | | |
|---|---|---|---|---|
| 9,359,653 | B2 | 6/2016 | Garrison, Jr. | |
| 10,458,007 | B2 | 10/2019 | Wert | |
| 10,472,706 | B2 | 11/2019 | Novotny | |
| 2010/0132854 | A1* | 6/2010 | Cola, Jr. | C21D 1/08 148/590 |
| 2019/0352738 | A1* | 11/2019 | Bonnet | C21D 9/573 |
| 2020/0061971 | A1* | 2/2020 | Wolske | C21D 6/008 |
| 2021/0371945 | A1 | 12/2021 | Roth et al. | |

OTHER PUBLICATIONS

HTA Brisbane—Aerospace Defense Line Card, https://hta-global.com/wp-content/uploads/2018/08/HTAAeroBNELC.pdf, 2 pages, Aug. 2018. (Year: 2018).*

Latrobe Lescalloy 4330+V VAC-ARC High Strength Alloy Steel, Metal Material Data Sheets, MatWeb, 1 page, 2021. (Year: 2021).*

L. E. Popov, V. S. Kobytev, T. A. Kovalevskaya, "Concepts of Strengthening and Dynamic Recovery in the Theory of Plastic Deformation," Tomsk Civil-Engineering Institute, pp. 520-541, Plenum Publishing Corp., translated from Izvestiya Vysshikh Uchebnykh Zavedenii, Fizika, No. 6, pp. 56-81, Jun. 1982. (Year: 1982).*

Aidang Shan and Liming Fu, "Heat Treating of Air-Hardening High-Strength Structural Steels," vol. 4D: Heat Treating of Irons and Steels, edited by J. Dossett and G.E. Totten, ASM International, 2014, pp. 169-178. (Year: 2014).*

"Glossary of Metallurgical and Metalworking Terms," Metals Handbook, ASM Handbooks Online, ASM International, 2002, pp. 1, 72, 73, 257. (Year: 2002).*

European Patent Office, Partial European Search Report dated Jun. 10, 2024 in Application No. 24156373.3.

European Patent Office, European Search Report dated Sep. 3, 2024 in Application No. 24156373.3.

* cited by examiner

210

| ID | DIR | HEAT | LOC | UTS (KSI) | YTS (KSI) | %e | %RA |
|---|---|---|---|---|---|---|---|
| 1A1 | L | 18 | GAS | 252 | 208 | 13 | 57 |
| 1B1 | L | 18 | GAS | 253 | 207 | 13 | 56 |
| 1C1 | L | 18 | GAS CENTRE | 224 | 177 | 16 | 65 |
| 1C2 | L | 18 | GAS CENTRE | 223 | 176 | 16 | 63 |
| 2A1 | L | 18 | OIL EDGE | 238 | 194 | 13 | 58 |
| 2B1 | L | 18 | OIL EDGE | 238 | 194 | 14 | 61 |
| 2C1 | L | 18 | OIL CENTRE | 249 | 205 | 13 | 17 |
| 2C2 | L | 18 | OIL CENTRE | 248 | 205 | 14 | 57 |

310

| ID | DIR | HEAT | LOC | UTS (KSI) | YTS (KSI) | %e | %RA |
|---|---|---|---|---|---|---|---|
| 1A1 | L | 18 | GAS | 252 | 208 | 13 | 57 |
| 1B1 | L | 18 | GAS | 253 | 207 | 13 | 56 |
| 1C1 | L | 18 | GAS CENTRE | 224 | 177 | 16 | 65 |
| 1C2 | L | 18 | GAS CENTRE | 223 | 176 | 16 | 63 |
| 2A1 | L | 18 | OIL EDGE | 238 | 194 | 13 | 58 |
| 2B1 | L | 18 | OIL EDGE | 238 | 194 | 14 | 61 |
| 2C1 | L | 18 | OIL CENTRE | 249 | 205 | 13 | 17 |
| 2C2 | L | 18 | OIL CENTRE | 248 | 205 | 14 | 57 |

METHOD FOR INCREASING THE ULTIMATE TENSILE STRESS (UTS) AND YIELD STRENGTH (YS) OF HIGH-STRENGTH MARTENSITIC STEELS

FIELD

The present disclosure relates to forming high strength materials and in particular to a controlled cooling process in a heat treatment (i.e., cooling rate upon quenching) process to boost steel strength.

BACKGROUND

Aircraft landing gear typically employ the use of high strength materials because of the stress incurred during the takeoff and landing. The high strength materials employed include steel alloy of a class defined as "ultra-high strength steels". For example, the 300M low alloy steel, is included in the SAE AMS6417, SAE AMS6419 specifications ("300M"), and 4330V steel alloy is included in the SAE AMS6411 specification ("4330V"). These steel alloys (i.e., the 300M and 4330V) can provide an optimum balance between component design factors of weight, stiffness, and fatigue for a set of minimum design allowable properties at a cost lower than titanium alloys. By increasing the values of steel material properties such as the Ultimate Tensile Strength (UTS) and, to a lower extent, the Yield Strength (YS), this can result in a lighter design product and allows a more competitive advantage in the component manufacture process of the product while meeting the desired properties of high strength materials.

SUMMARY

In various embodiments, a method of implementing a heat treatment process for enhancing strength of a part is provided. The method comprises controlling, by a controller, a set of parameters that adjusts a cooling rate for at least a gas quenching process to enable a controlled operation for cooling the part from a critical temperature maintained for a period of time wherein the part comprises a steel material wherein the controlled operation for cooling the part is a subsequent action in the heat treatment process applied after the steel material of the part has been determined to have reached the critical temperature based on part thickness; and controlling, by the controller, the cooling of the steel material of the part in the gas quenching process by affecting of changes in the cooling rate over one or more increments of time for the cooling of the part that results in at least an increase in value of an Ultimate Tensile Strength (UTS) of the steel material in correspondence with a decrease in the cooling rate by the controller.

In various embodiments, the controlled cooling in the gas quenching process of the part affected by changes in a cooling rate results in at least the increase in value of a Yield Strength (YS) of the steel material in correspondence with a decrease in the cooling rate by the controller.

In various embodiments, the method further comprises applying, by the controller, the gas quenching process with the controlled cooling of the part in a constrained environment for the part that results in further increases in value of either the UTS or YS of the steel material.

In various embodiments, the method further comprises applying, by the controller, the gas quenching process with the controlled cooling at a slower-rate than an oil quenching process that results in higher strength and corresponding further increases in value of either the UTS or YS of the steel material.

In various embodiments, the controlled cooling in the gas quenching process can result in increase in values of the UTS and YS of the steel material wherein the controlled cooling by the gas quenching process is a lower cooling rate than a controlled cooling rate by the oil quenching process.

In various embodiments, the increase in values of the UTS and YS of the steel material can result in the part having a higher minimum design allowable.

In various embodiments, the steel material comprises a 300M steel material.

In various embodiments, the steel material comprises a 4330V steel material.

In various embodiments, the changes in the cooling rate by the controller in the controlled cooling using gas quenching incur costs comparable to current heat treatment processes.

In various embodiments, the 300M steel material, the value of the UTS can increase from approximately 280 ksi to 290 ksi In various embodiments, the 300M steel material, the value of the YS can increase from approximately 230 ksi to 240 ksi.

In various embodiments, the 4330V steel material, the value of the UTS can increase from approximately 220 ksi to 230 ksi.

In various embodiments, the 4330V steel material, the value of the YS can increase in a range from approximately 185 ksi to 195 ksi.

In various embodiments, a method of implementing a heat treatment process for enhancing strength of a part is provided. The method includes applying, by a controller, an oil quenching process to enable a controlled operation for cooling the part wherein the part comprises a steel material wherein the controlled operation for cooling the part is a subsequent action in the heat treatment process applied after the steel material of the part has been heated to a critical temperature for a period of time; and controlling, by the controller, the cooling of the steel material of the part in the oil quenching process by affecting of changes in a cooling rate over one or more increments of time for the cooling of the part that results in at least an increase in value of an Ultimate Tensile Strength (UTS) of the steel material in correspondence with a decrease in the cooling rate by the controller.

In various embodiments, the controlled cooling in the oil quenching process of the part affected by changes in cooling rate results in at least the increase in value of a Yield Strength (YS) of the steel material in correspondence with a decrease in the cooling rate by the controller.

In various embodiments, the method further comprises applying, by the controller, the oil quenching process with the controlled cooling of the part in a constraint environment for the part that results in further increases in value of either the UTS or YS of the steel material.

In various embodiments, the method further comprises applying, by the controller, the oil quenching process with the controlled cooling at a slower-rate than at a gas quenching process that results in higher strength and corresponding further increase in value of either the UTS or YS of the steel material.

In various embodiments, the controlled cooling in the oil quenching process can result in increase in values of the UTS and YS of the steel material.

In various embodiments, the increase in values of the UTS and YS of the steel material can result in the part having a higher minimum design allowable.

In various embodiments, the steel material comprises a 300M steel material; and wherein the steel material comprises a 4330V steel material.

The forgoing features and elements may be combined in various combinations without exclusivity, unless expressly indicated herein otherwise. These features and elements as well as the operation of the disclosed embodiments will become more apparent in light of the following description and accompanying drawings.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

In various embodiments, higher strength levels up to at least 150 ksi 0.2% PS or greater may be achieved by suitable heat treatment.

In various embodiments, in components, there is a preference to AISI 4140 at the higher strength levels because of its better hardenability and improved CVN impact toughness. Due to availability, this grade is often substituted with European based standards 817M40, EN24 and 1.6528 34CrNiMo6; which are similar but have a slightly lower nominal nickel content of 1.5% and higher nominal chromium content of 1.3%. The hardenability limitations of this grade (i.e., the depth to which it will harden/obtain the specified mechanical properties after heat treatment) should always be considered when designing and in use in parts in an aircraft.

In various embodiments, 4330V is included in the specifications: AMS 6427, SAE AMS 6411, ASTM A646, and UNS K23080.

Typical mechanical properties of AISI 4330V Alloy Steel

| | Tensile ksi | .2% Proof Stress | Elongation % | Reduction of Area | Hardness HRc | Hardness Brinell |
|---|---|---|---|---|---|---|
| Min | 150 | 140 | 15 | 59 | 35 | 331 |
| Max | 190 | 180 | | | 39 | 370 |

At room temperature heat treated 35-39 HRc

The compositive analysis of the 4330V comprises:

Analysis:

| | |
|---|---|
| Carbon 0.30-.34% | Silicon 0.15-0.35% |
| Manganese 0.75-1.00% | Chromium 0.75-1.00% |
| Molybdenum 0.40-0.50% | Nickel 1.65-2.00% |
| Sulphur 0.40-0.50% | Phosphorou 0.035% Max. |
| Vanadium 0.05-0.10% | |

In various embodiments, 300M is a low alloy, vacuum melted, steel of high strength and can be considered as a modified AISI 4340 steel with silicon, vanadium and slightly greater carbon and molybdenum content than AISI 4340. The 300M has a combination of strength (280 to 305 ksi), toughness, fatigue strength and good ductility. These specifications cover Alloy Steels 300M: AMS 6417, AMS 6419, ASTM A579 (32), ASTM A646 (300M-8), MIL S-8844 (3), MIL S-8844 Class 2, and UNS K44220.

In various embodiments, uses for 300M steel part are those that require strength in the 290 ksi to 300 ksi range, such as aircraft landing gear, high strength bolts, flap tracks, structural applications, and airframe parts.

Figure 1:
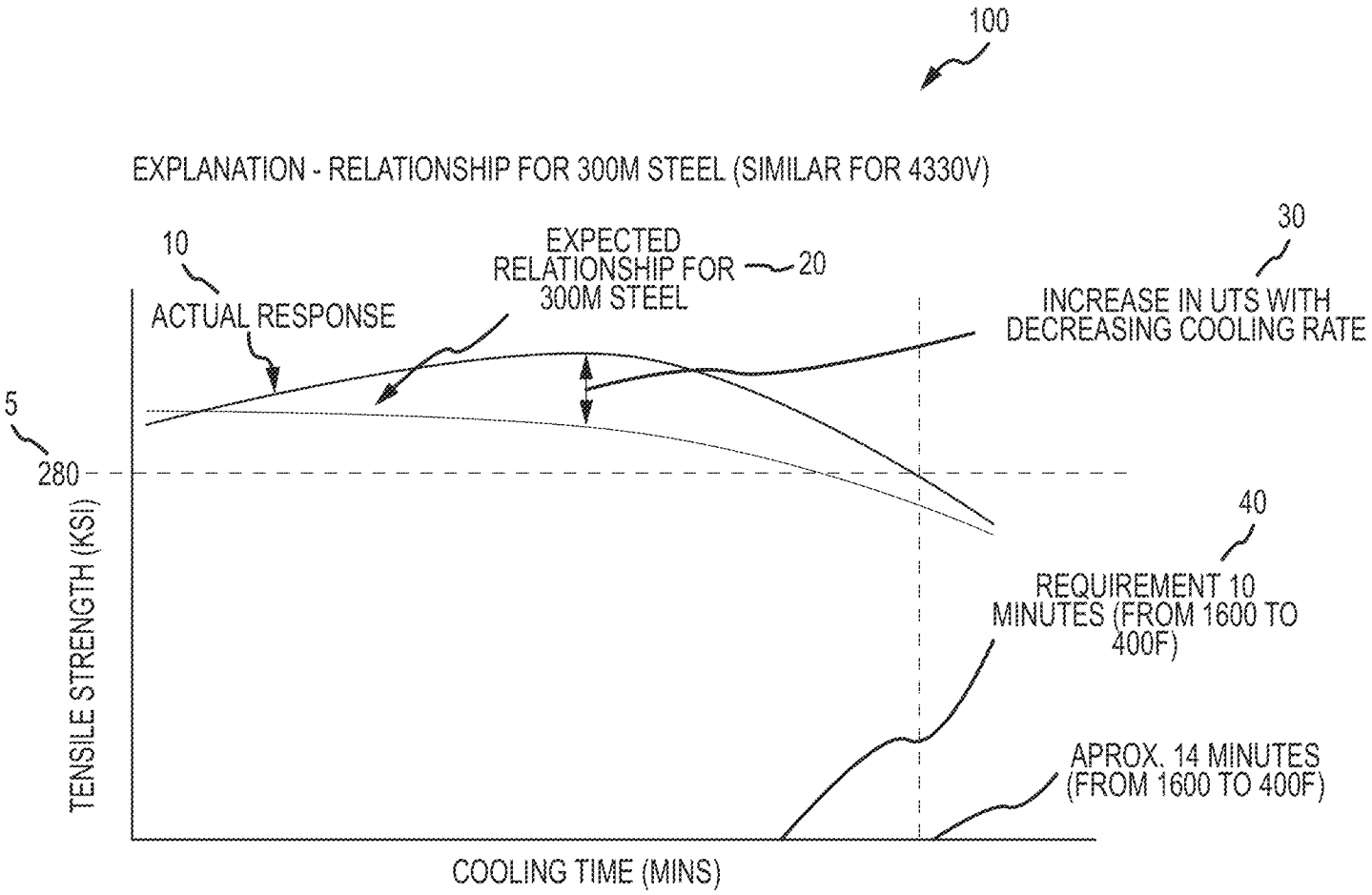
FIG. 1 illustrates a graph of the relationship of tensile strength compared to cooling time for a specimen (part) composed of a 300M steel material in accordance with various embodiments.

Referring to FIG. 1, FIG. 1 illustrates a graph 100 of the relationship of tensile strength compared to cooling time for a specimen (part) composed of a 300M steel material in accordance with various embodiments. The graph 100 depicted for the specimen of the 300M is similar to graph response exhibited by a similar sized specimen of 4330V steel showing similar comparative responses of actual and expected tensile strength over cooling time.

In FIG. 1, in the graph 100, the actual response 10 of a strength comparison of a specimen (part) composed of 300M steel after a heating step and in response to being subjected to a controlled cooling process by gas quenching (or otherwise) is compared in time intervals (time increments) to its tensile strength (ksi). The change in value of the tensile strength is shown as the controlled cooling via gas quenching progresses for the specimen composed of 300M steel.

In various embodiments, the steel 300M steel specimen is hardened and tempered to a tensile strength (as the cooling time progresses) that is above a threshold of about 280 ksi (see threshold line 5). The specimen in accordance with the actual strength value response (actual response 10) in the graph 100 increases (a little after the midpoint of the cooling cycle of 10 minutes (40)) to its highest value, exceeding the requirements for high strength materials of at least 285 ksi (actual response 10), and approaches about 290 ksi.

In various embodiments, the specimen or part used in the testing is approximately 3-inch (7.62 centimeters) thick section composed of 300M and is heat treated. The center of the specimen (see FIG. 4A for the tested set of specimens) because of its interior location has a slower cooling rate, and this results in a higher strength value of approximately ~14 ksi higher than the strength values measured at its edges.

In various embodiments, under heat treatment requirements for gas quenching, the specimen of the steel (alloy) part composed of the 300M material require a controlled cooling for a period of approximately 10 minutes after the specimen has been heated to a critical temperature. The critical temperature for heat treatment of 300M steel is approximately or in a range of 1600° F. (871° C.).

In various embodiments, the graph 100 shows the values of the strength of the specimen responsive to cooling rates of 10 minutes (i.e., gas quench requirement) and 14 minutes for the steel specimen 300M material when control cooled from (a critical temperature) approximately 1600° F. (871° C.) to about to about 400° F. (204.4° C.).

In various embodiments, the measured strength of the specimen to the cooling actually observed (i.e., the actual response 10) versus the expected values of strength (expected 20) differ slightly by the actual measured strengths of the 300M specimen showing an increase in strength values before the end of the controlled cooling period. As the cooling time increases beyond 14 minutes, the measured strength values decreases slightly. At a certain point 30 before the 10-minute gas quenching requirement, the strength value for the 300M specimen is actually greater than expected.

However, the actual response 10 to the progressive cooling shows a greater strength value throughout the entire cooling process than the expected strength values for the part/specimen. The increase in value of an Ultimate Tensile Strength (UTS) of the steel material also corresponds with a decrease in the cooling rate as the instructed controller controls the cooling process.

In various embodiments, for a specimen composed of 4330V steel material, the response values expected (expected 20) to the actual response values of strength shown were similar to the 300M specimen of a same size.

In various embodiments, the 300M and 4330V steels exhibits a boost in strength of about 5 percent for a combined set of strength values of both the UTS and YS from the heat treatment with a cooling rate upon quenching controlled within periods up to 14 minutes. This increase is similarly applicable for tested specimens or parts composed of either 4330V and 300M steel alloys and correspond to changes in martensite lath morphology, twinning and/or secondary precipitation of micro-alloying elements Cr, V and Mo of various steel alloys.

In various embodiments, a three-inch (length) specimen of 300M material is tested, and for the heat treatment that is applied, is first austenitized or heat treated by heating either the specimen of 300M or 4330V to a critical temperature of about 1550-1650° F. (621° C. to 898° C.) for about 1 hour plus about 5 minutes per inch of thickness and then quenching the specimen using either an oil quenching process, or a gas quenching process.

If a 3-inch (7.62 centimeters)-thick section of 300M is heat treated, the material at the core (i.e., because of having a slower cooling rate) will be ~14 ksi stronger than the material at the outer surfaces (i.e., because of having a faster cooling rate). The cooling can be controlled to the desired rate by gas quenching. The existing allowable and fatigue data still apply, however for 300M, the UTS would increase from 280 ksi to about 290 ksi, and the YS from 230 ksi to about 240 ksi. A similar increase applies to parts composed of the 4330V material.

Figures 2A, 2B:
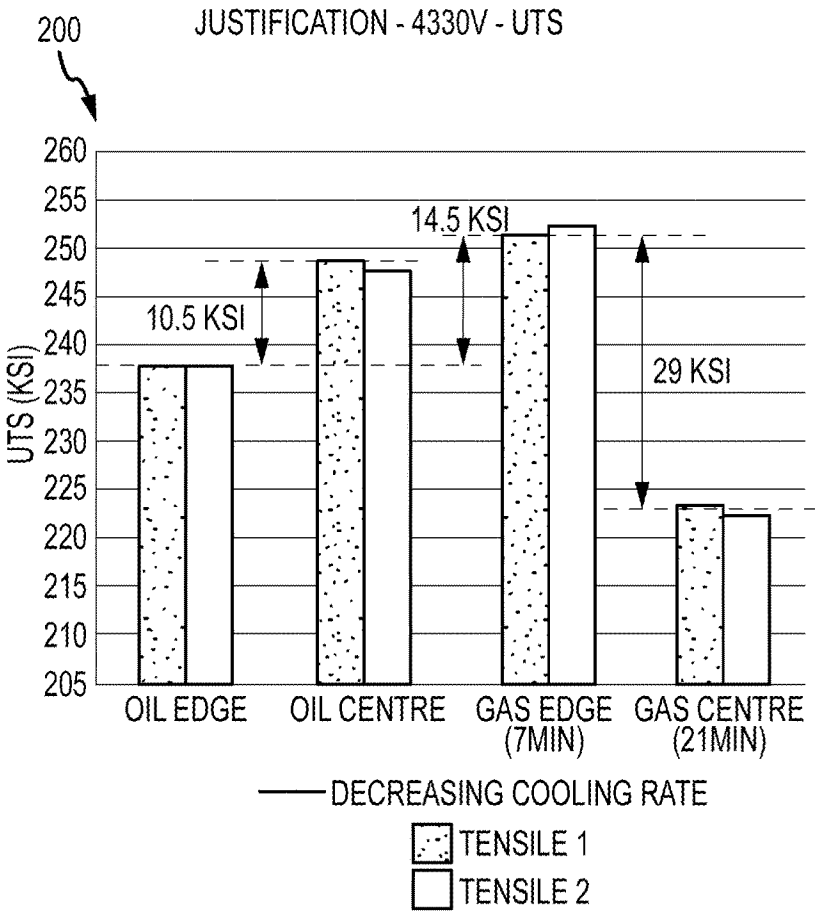
FIG. 2A is a block chart of comparisons of Ultimate Tensile Strength (UTS) values of specimens composed of the 4330V material measured at outside edges compared with interior center portions showing variation of UTS with decreasing cooling rate in accordance with various embodiments.
FIG. 2B is a table of UTS values for longitudinal (Long.) direction associated with decreasing cooling rate in accordance with various embodiments.

FIG. 2A is a block chart of comparisons of UT strength values of specimens composed of the 4330V material measured at the outside edges compared with interior center portions in accordance with various embodiments. In the block chart 200 of FIG. 2A, a set of comparative tests is performed for tensile strengths of two individual specimens subjected to different controlled cooling processes of an oil cooling (quench) process and a gas (quench) cooling process, and a comparative strength analysis of measured values is shown between both sets of specimens subjected to either controlled cooling process. The set up includes measurements and comparisons of both sets of specimens between strength values of the specimen's edges (outside) and center (interior) that are control cooled at different rates because of the thickness of the specimen. Also, in the block chart 200 is a comparison of the strength values (UTS) of the specimen's edge/center for the gas quench versus the edge/center for the oil quench.

In various embodiments, the strength measurements are performed at the edge of a sample and at the center thus effecting different cooling rates. A similar comparison is made between edge and center of an identical sample of the same material bar but cooled slower using the gas quench process. The later cooling rates were measured as 7 minutes at the edge and 21 minutes at the center. The control environment is performed with each specimen configured in a comparable size and shape and positioned in a like manner in the oil quench and the gas quench treatment.

In various embodiments, the block chart 200 shows that results aligned with decreasing the cooling rate, by going from a smaller thermal mass (the edge to the center of sample) quenched in oil and decreasing the cooling rate even further by going from oil to the gas quenching, and further illustrates the differences in thermal mas from edge to center during gas quenching. The UTS is seen to increase with decreasing cooling rate up to 7 minutes. But decreasing the cooling rate to 21 minutes causes the UTS to decrease significantly.

In various embodiments, the block chart 200 in FIG. 2A shows an increase in the UTS measured values between oil quench of edge/center of 10.5 ksi, between oil/gas edges of 14.5 ksi. However, decreasing the cooling rate to 21 minutes causes a decrease in the UTS of 29 ksi.

FIG. 2B is a table 210 of UTS values compared for longitudinal (Long.) and location strength values of the specimen in accordance with various embodiments. In various embodiments, the specimens are all 4330V from a single bar of material and subjected to testing of a controlled cooling in accordance with various embodiments.

In various embodiments, the table 210 of FIG. 2B shows corresponding individual test values to the bar chart of FIG. 2A of the measured strengths in longitudinal direction and locations and includes the yield strength (YS) and the ultimate tensile strength (UTS) in ksi and the percent elongation and percent reduction in area (RA). For each data point, two adjacent specimens were extracted, the variance between specimens is small when compared to the variation in strength described in preceding paragraphs.

Figures 3A, 3B:
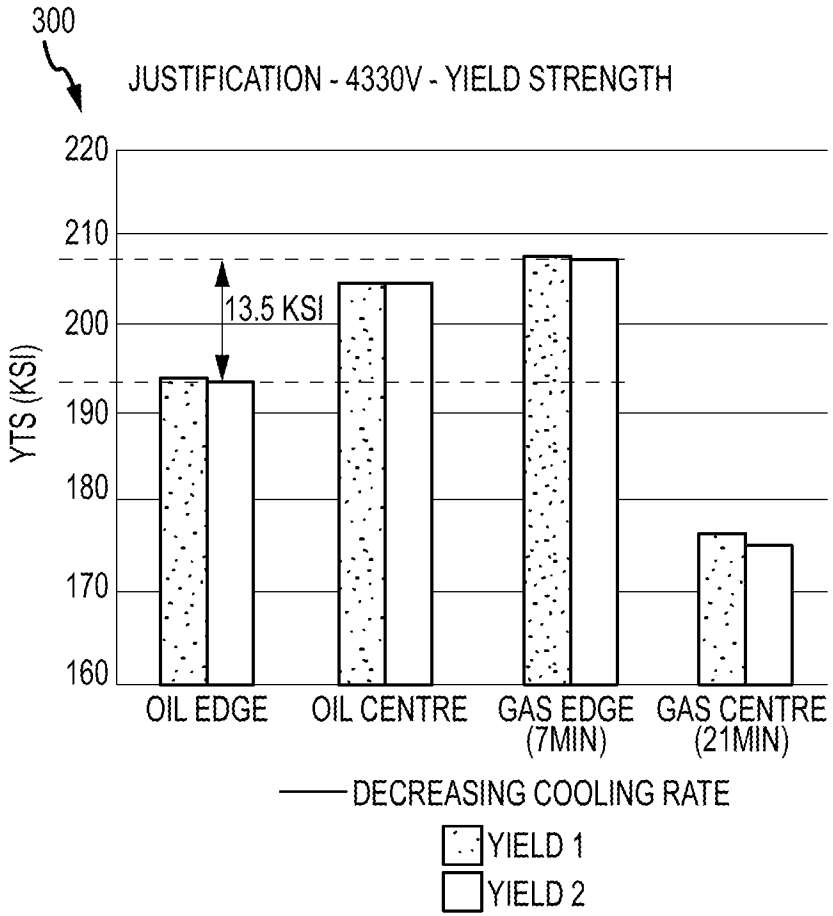
FIG. 3A is a block chart of comparisons of Yield Strength (YS) values of specimens composed of the 4330V material measured at outside edges compared with interior center portions showing variation of UTS with decreasing cooling rate in accordance with various embodiments.
FIG. 3B is a table of YS values for longitudinal direction associated with decreasing cooling rate.

FIG. 3A is a block chart of comparisons of Yield strength values of specimens composed of the 4330V material measured at the outside edges compared with interior center portions in accordance with various embodiments. In the block chart 300 of FIG. 3A, a set of comparative tests is performed for tensile strengths of two individual specimens subjected to different controlled cooling processes of an oil cooling (quench) process and a gas (quench) cooling process, and a comparative strength analysis of measured values is shown between both sets of specimens subjected to either controlled cooling process. The set up includes measurements and comparisons of both sets of specimens between strength values of the specimen's edges (outside) and center (interior) that are control cooled at different rates because of the thickness of the specimen. Also, in the block chart 300 is a comparison of the strength values (YS) of the specimen's edge/center for the gas quench versus the edge/center for the oil quench.

FIG. 3B is a table of YS values compared for longitudinal (Long.) and location strength values of the specimen in accordance with various embodiments. In various embodiments, the specimens are all 4330V from a single bar of material and subjected to testing of a controlled cooling in accordance with various embodiments.

In various embodiments, the specimens are parts all composed of 4330V from a single bar of material and subjected to testing of a controlled cooling in accordance with various embodiments. In various embodiments, the table 310 of FIG. 3B shows corresponding individual test values to the bar chart of FIG. 3A of the measured strengths in longitudinal (Long.) and locations and includes the yield strength (YS) and the ultimate tensile strength (UTS) in Ksi and the percent elongation and percent reduction in area (RA). For each data point, two adjacent specimens were extracted, the variance between specimens is small when compared to the variation in strength described in preceding paragraphs.

Figure 4A:
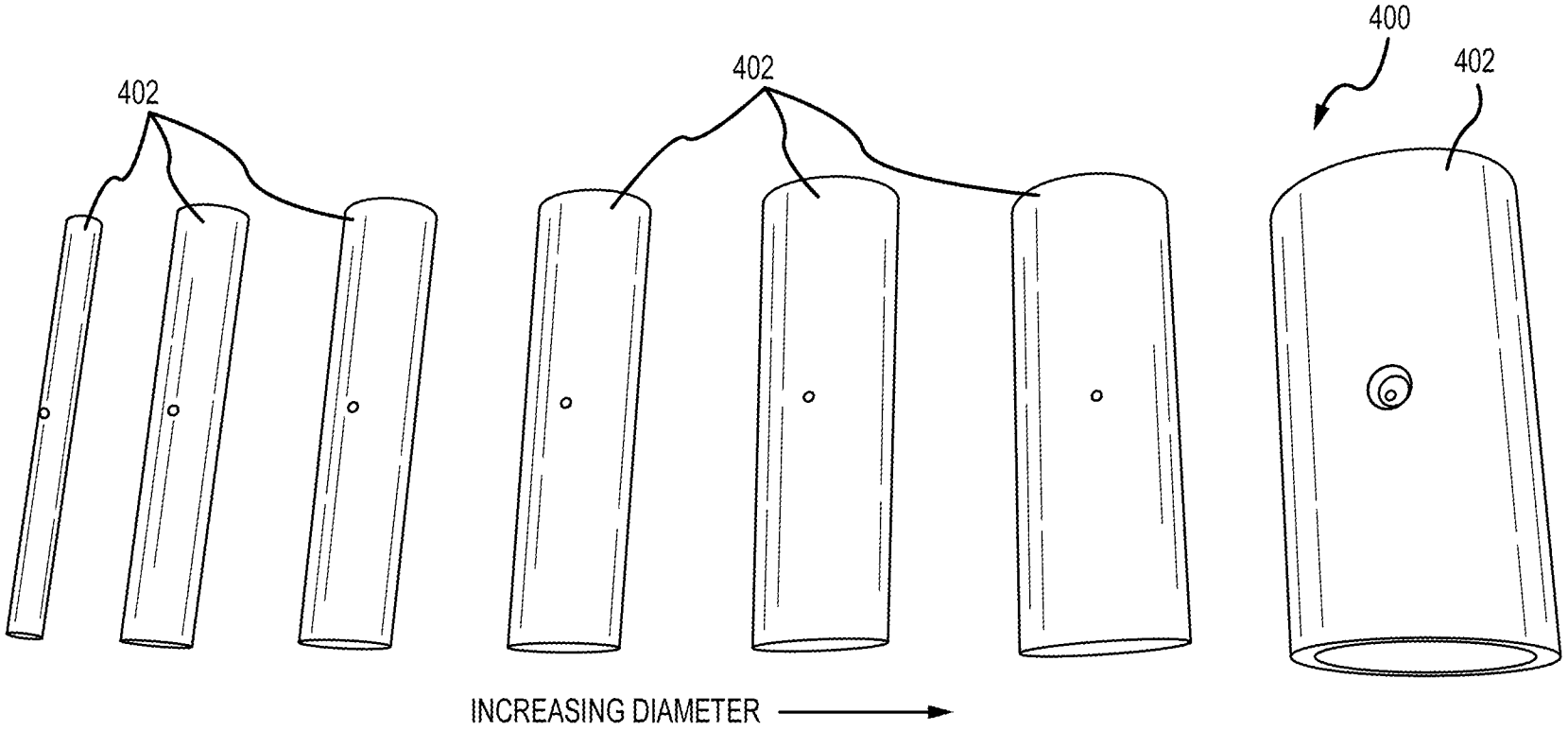
FIG. 4A. illustrates a diagrams of a set of bar specimens of different diameters used to simulate cooling rates in accordance with various embodiments.

FIG. 4A. is an illustration of bar specimens 400 of different diameters used to simulate cooling rates. All specimens were machined using a single 2.25" diameter bar that was reconfigured. Small holes at mid-length of each bar specimen 402 enable installation of thermocouples to measure cooling rate (change in temperature vs. time). Two tensile specimens were machined from each of the bar specimens 402.

Figure 4B:
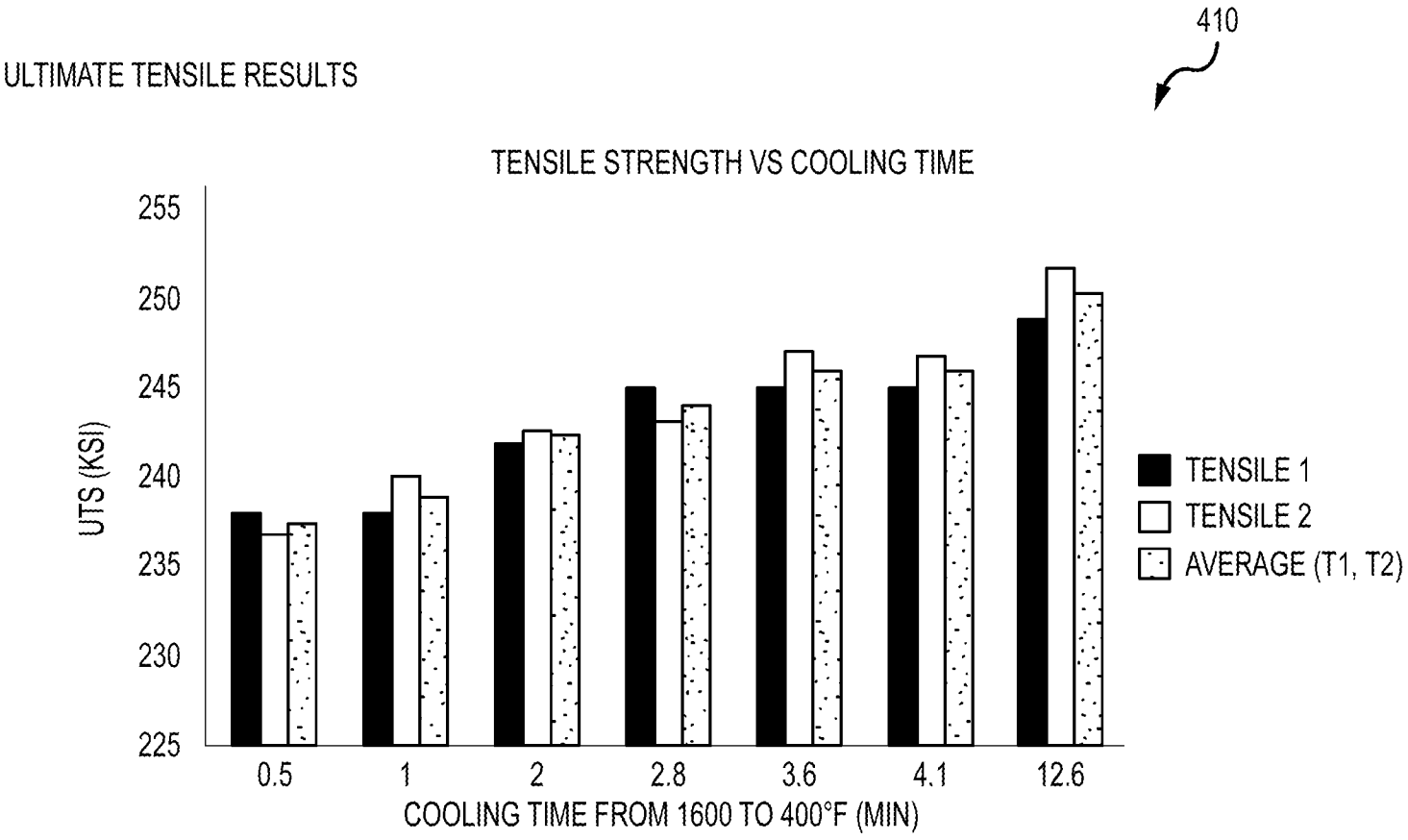
FIG. 4B is a block chart of comparisons of tensile strength (UTS) of specimens to cooling time in increments in accordance with various embodiments.

FIG. 4B is a block chart 410 of comparisons of tensile strength (UTS) of specimens to cooling time in increments in accordance with various embodiments. The chart shows that as the cooling time increases from 0.5 to 12.6 minutes, the tensile strength increases. The cooling time is measured from the 1600 F (Austenitize temperature) to 400 F (below the Martensite Start temperature).

Figure 5:
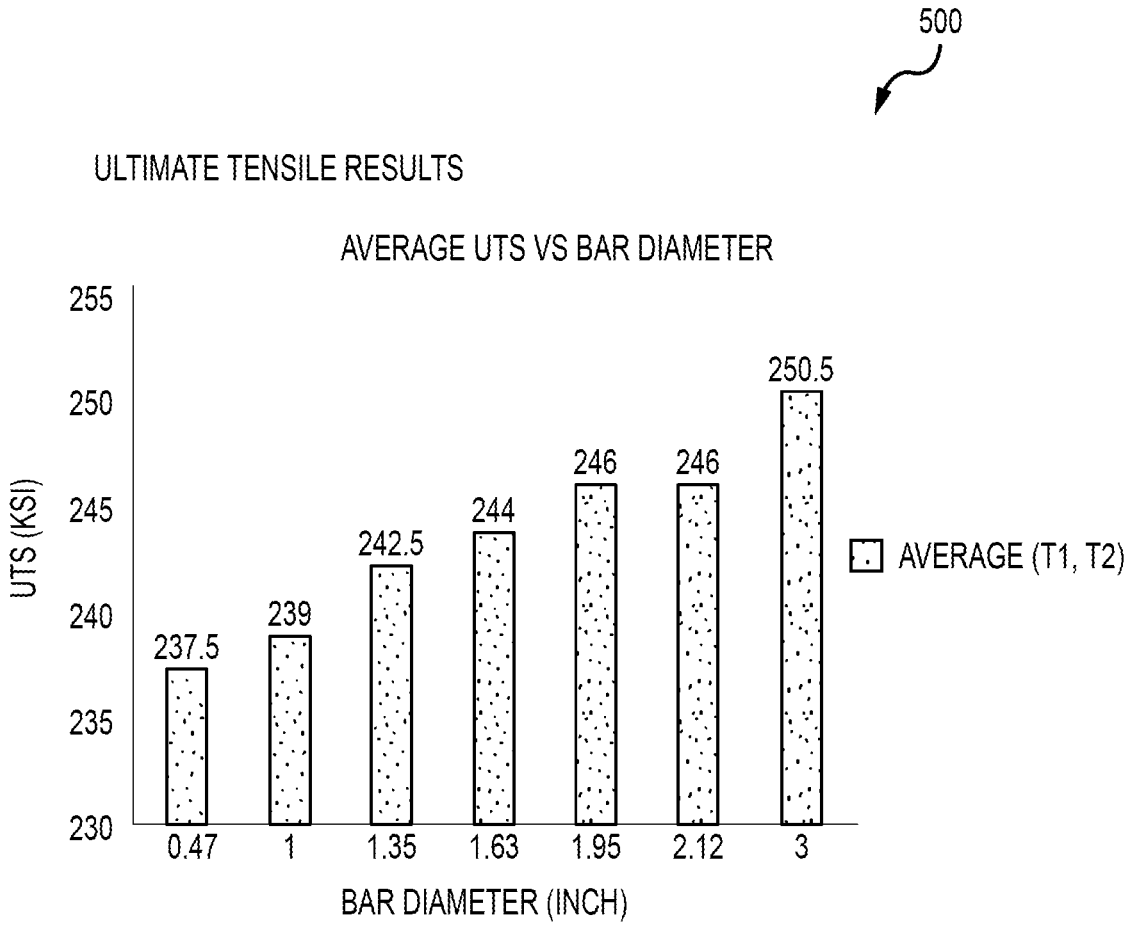
FIG. 5 is a block chart of comparisons of tensile strength (UTS) and bar diameter of specimens in accordance with various embodiments.

FIG. 5 is a block chart 500 of comparisons of tensile strength (average of two specimens) (UTS) and bar diameter of specimens in accordance with various embodiments. The chart shows that as the bar diameter increases from 0.47 inches (1.194 centimeters) to 3.0 inches (7.62 centimeters), the tensile strength increases. The cooling time is measured from the 1600 F (Austenitize temperature) to 400 F (below the Martensite Start temperature).

Figure 6:
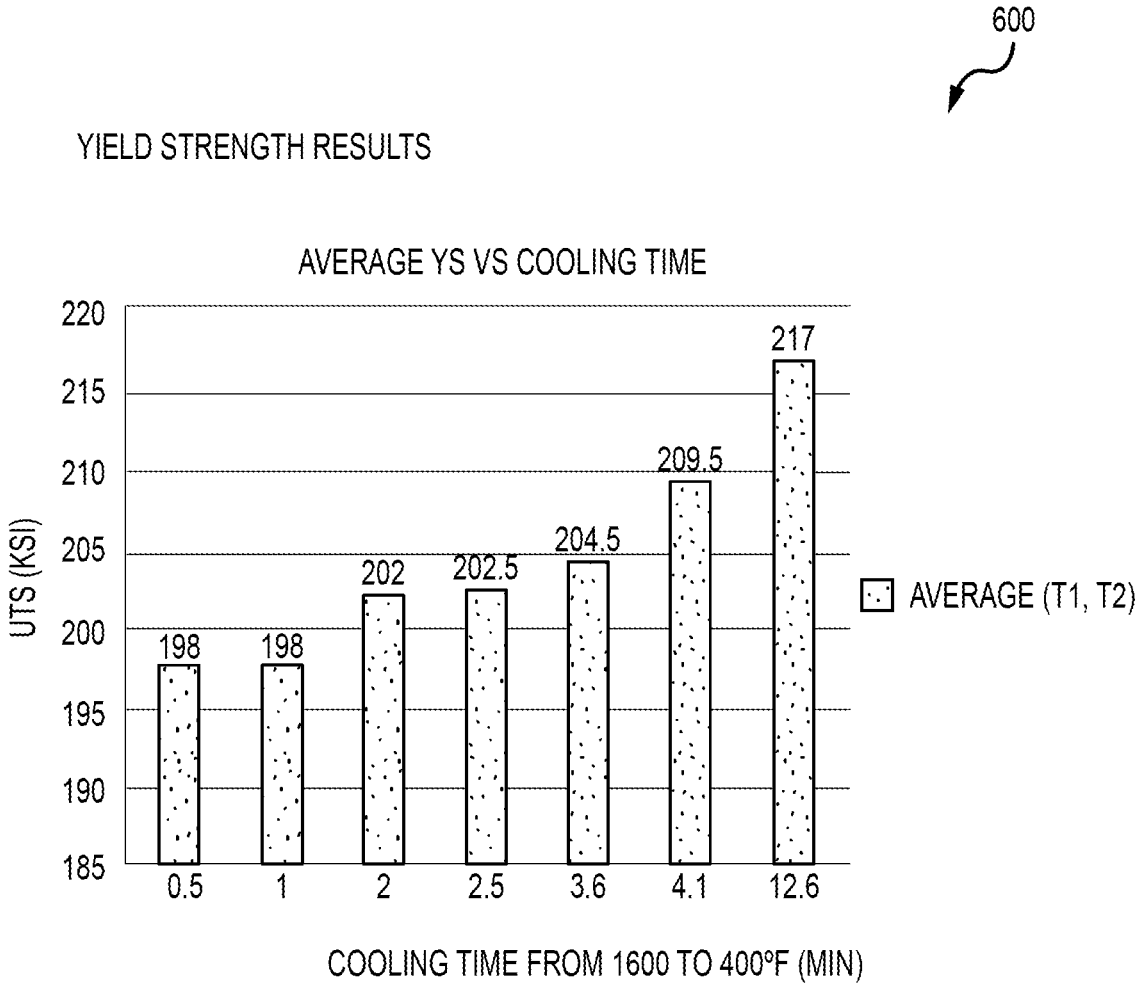
FIG. 6 is a block chart of comparisons of yield strength (YS) to cooling time of specimens in accordance with various embodiments.

FIG. 6 is a block chart 600 of comparisons of yield strength (average of two specimens) (YS) to cooling time of specimens in accordance with various embodiments. The chart shows that as the cooling time increases from 0.5 to 12.6 minutes, the yield strength increases. The cooling time is measured from the 1600 F (Austenitize temperature) to 400 F (below the Martensite Start temperature).

Figure 7:
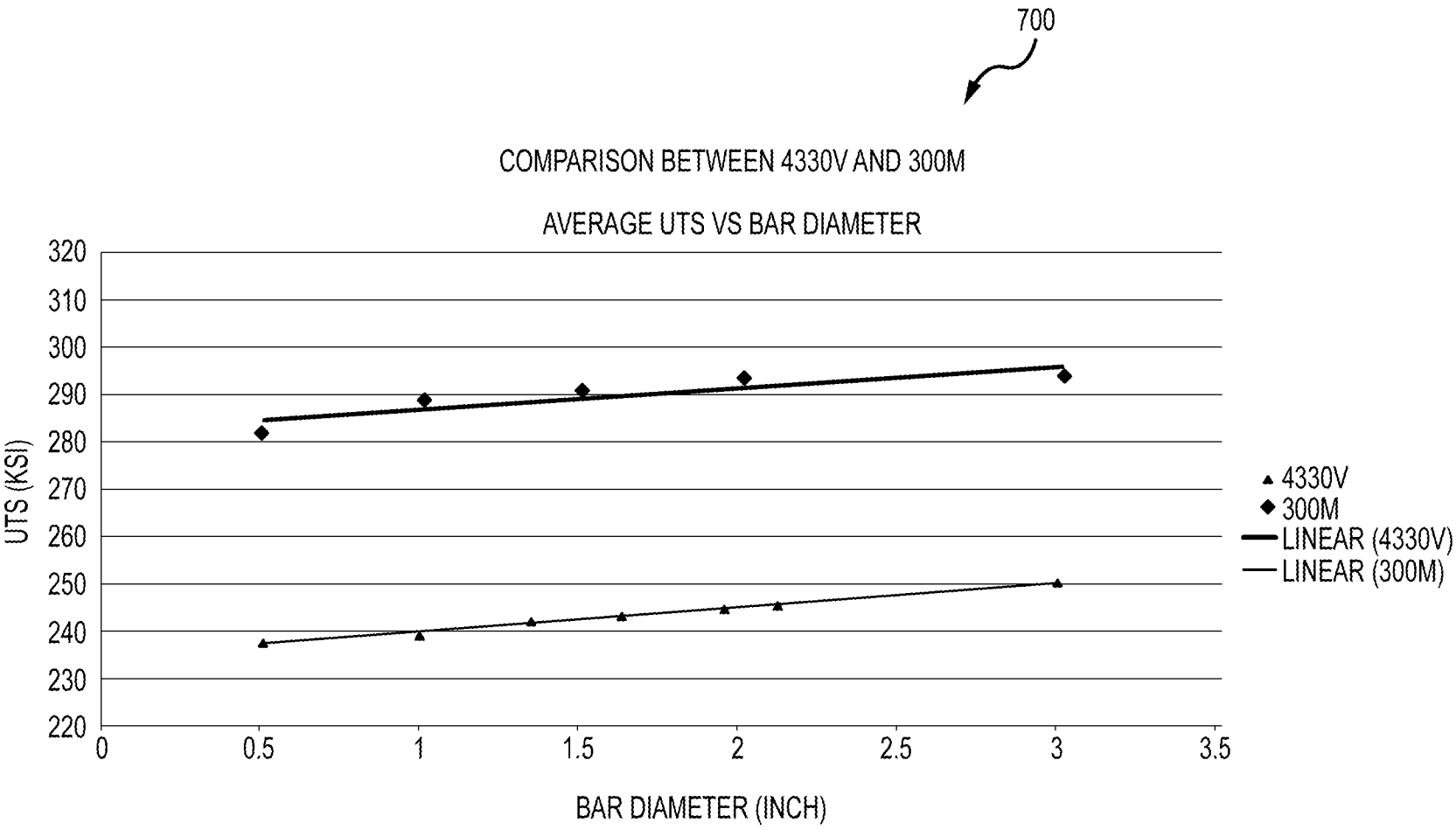
FIG. 7 is a graph of comparisons of UTS between specimens of 4330V and 300M with changes in test bar diameter in accordance with various embodiments.

FIG. 7 is a graph 700 of comparisons of UTS between specimens of 4330V and 300M with changes in diameter in accordance with various embodiments. This chart highlights that a similar trend regarding the increase in UTS with increasing bar diameter (decreasing cooling rate) for 4330V and for 300M alloy steels.

Figure 8:
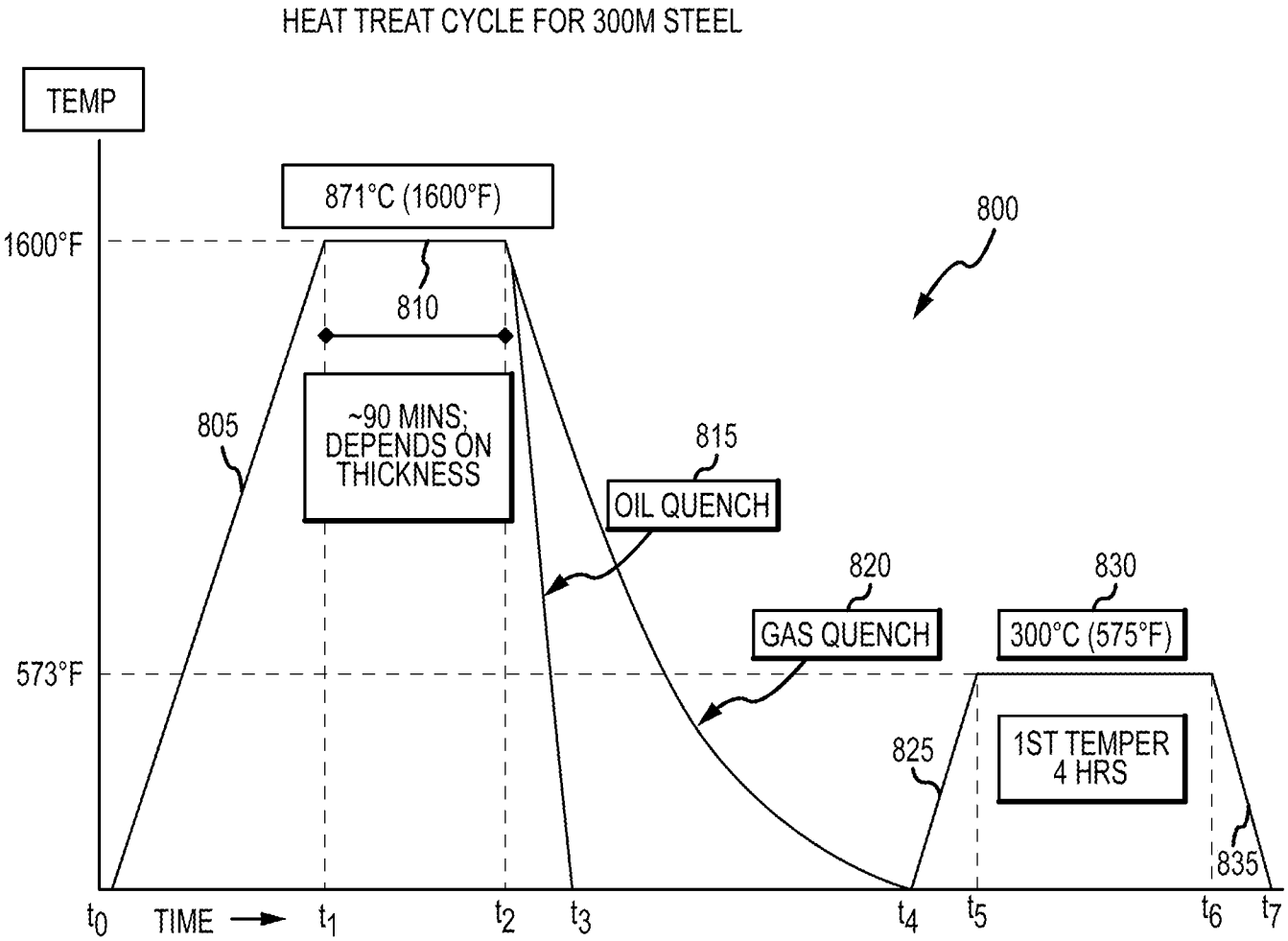
FIG. 8 illustrates a diagram of a heat treatment cycle for either oil or gas quench processes for 300M steel in accordance with various embodiments.

FIG. 8 is a diagram 800 of the heat treatment cycle for 300M steel in accordance with embodiments. In FIG. 8, in the first phase 805 to austenitize the steel alloy, the 300M is heated to 1600 F (871 C) at a first rate ($t_0$ to $t_1$), and then is kept at a transformative temperature (second phase 810) for approximately 90 minutes (kept at) at approximately 871 C (1600 F) then quenched to harden the steel alloy. The quenching may occur via a controlled oil quenching (phase 815) at a controlled cooling rate for the oil quench ($t_2$ to $t_3$). The quenching may occur via a gas quenching (phase 820) of the gas quench ($t_3$ to $t_4$). As illustrated in FIG. 8, the oil quench removes heat at a higher rate than the gas quenching. In various embodiments, either the gas quenching or the oil quenching is used, however, in various embodiments, both gas quenching and oil quenching may be used. In embodiments where 4330V steel is employed in place of 300M steel, a tempering phase at a heating rate 825 is applied to increase the ductility of 4330V. 4330V may be tempered at t5 at approximately 300 C (575 F) below a critical temperature at 830 for about 4 hours and then cooled at 835 at a rate ($t_5$ to $t_6$) similar to the oil or gas quenching rate. The tempering phase cooling takes place between $T_6$ to $T_7$. Tempering phase is repeated two times for 4330V alloy steel.

To control the cooling rate, thermocouples (temperature sensors) are positioned in the furnace. The gas quenching uses Argon, Helium, or mixtures of inert gases or less reactive gases such as nitrogen gas. To control the cooling rate, thermocouples (temperature sensors) are placed in the furnace to monitor the temperature while a recorder collects data on both temperature and time. Qualification of the "heat treat load" is typically required to qualify the quench method. Parameters to control the cooling rate during quenching comprise: gas pressure, gas flow, gas type, location of the "load" within the "hot zone," location of the cooling nozzles, number of nozzles, settings of flow through heat exchangers to cool the inert gas, etc.

Figure 9:
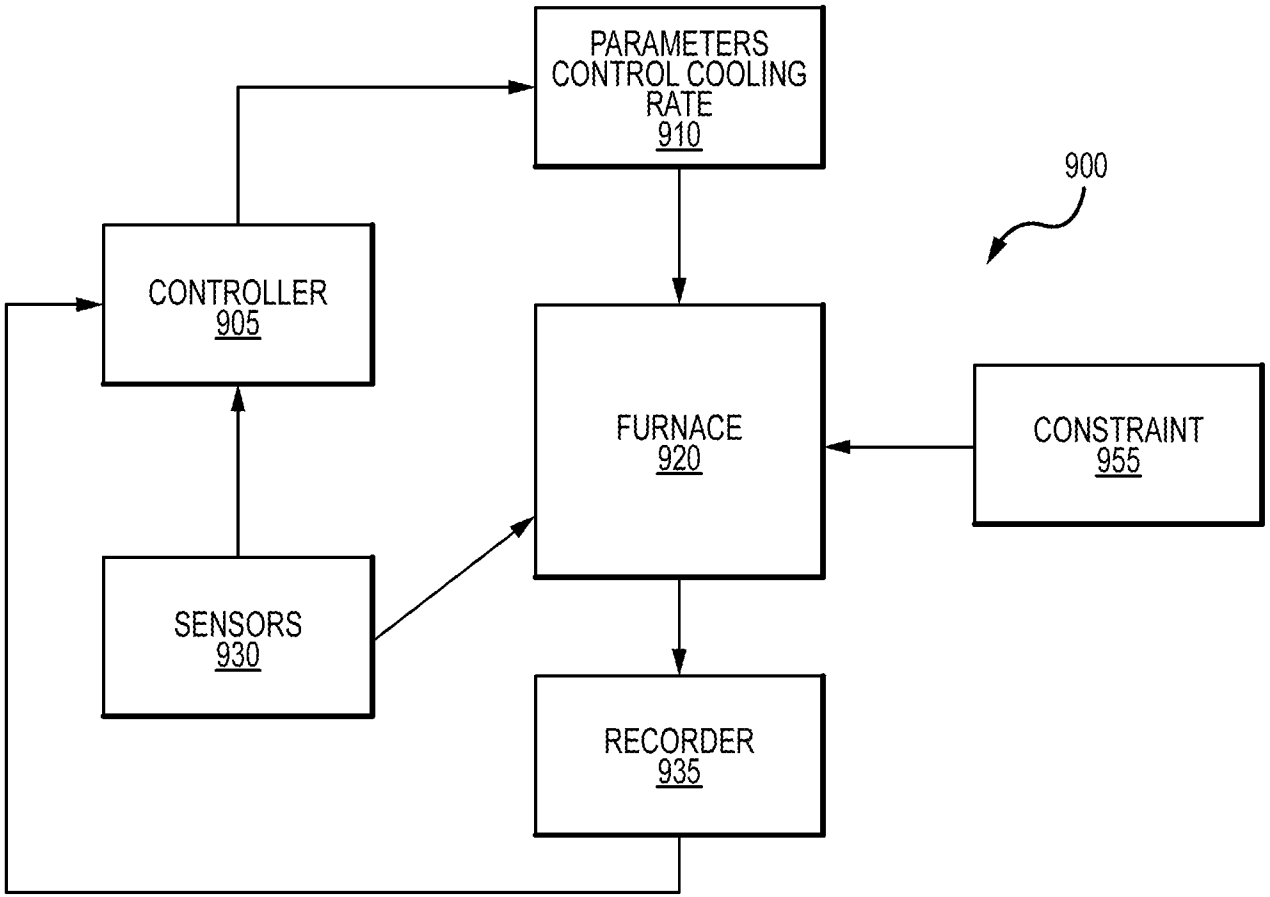
FIG. 9 is a diagram of control system for furnace with a controller and sensors for performing the gas quenching heat treatment in accordance with various embodiments.

FIG. 9 is a diagram of control system 900 for furnace with a controller and sensors for performing the gas quenching heat treatment in accordance with various embodiments. In FIG. 9, there is shown a controller 905 that controls various parameters 910 to adjust the cool rate of the furnace 920 in either gas quench or the air quench cooling process. The controller 905 receives sensor data of changes in temperature for a plurality of thermocouple sensors 930 that are positioned at the furnace 920 to monitor the various heating and cooling stages in the heat treatment process flow. The plurality of parameters 910 that are controlled by the controller 905 include the cooling rate during quenching are: gas pressure, gas flow, gas type, location of the "load" within the "hot zone", location of the cooling nozzles, number of nozzles, and settings of flow through heat exchangers to cool the inert gas. Also included in a recorder 935 that records temperature data and time for each stage of the heat treatment including the quenching application by the gas or oil processes. The furnace 920 is a vacuum type of furnace with a capability to perform high-pressure gas quenching using an inert gas, Argon, Helium, or a mixtures of inert gases. In various embodiments, the part composed of 300M or 4330V may be constraint in a holding device 955 during both the heating and cooling processes, where the constraint may cause an increase in the strength of the produced part.

Figure 10:
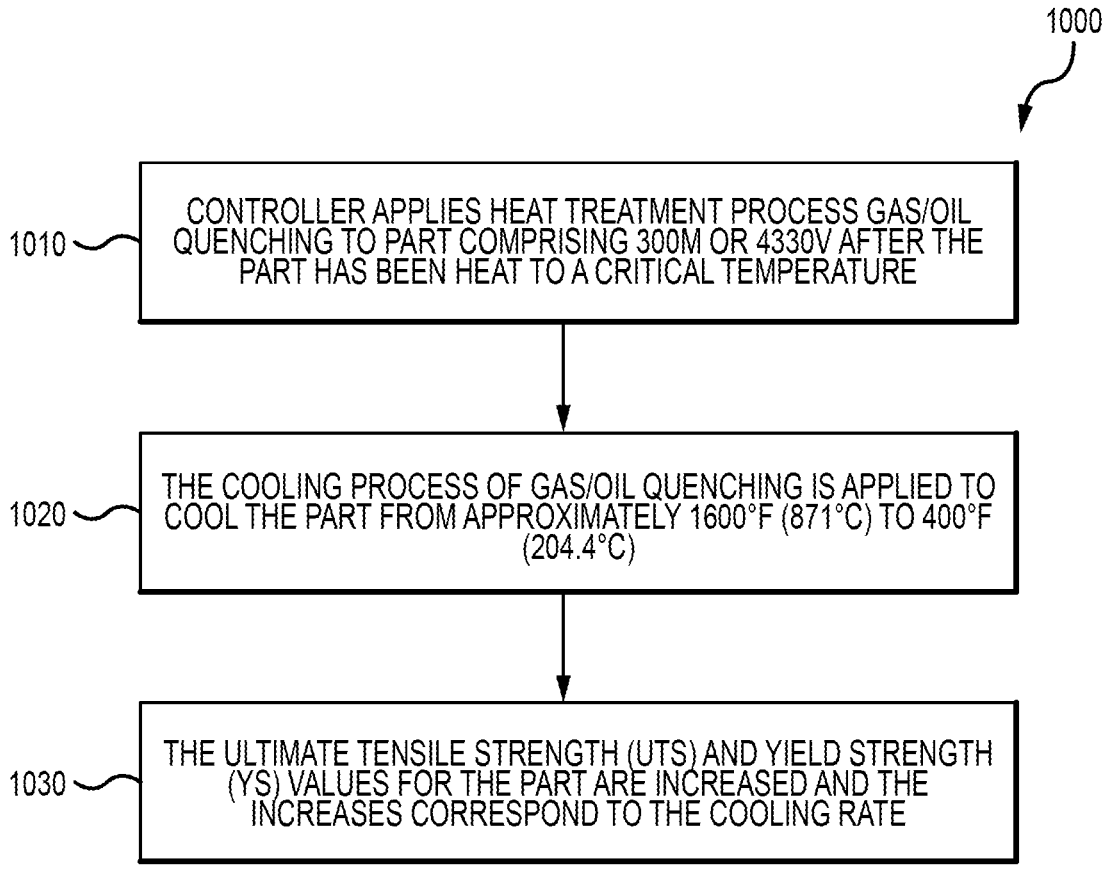
FIG. 10 is flow diagram of controlling the cooling rate of for either oil or gas quench processes for enhancing the strength of the part in accordance with various embodiments The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

FIG. 10 is flow diagram 1000 of controlling the cooling rate of for either oil or gas quench process for enhancing the strength of the part in accordance with various embodiments. At step 1010, a controller is configured to apply a heat treatment for process for either gas or oil quenching of a part composed of a steel alloy such as 300M or 4330V after the part has been heat to a critical temperature. At step 1020, the cooling process by either the gas or oil quenching is to effect a cooling rate between 1.0° C. (33.8 degree Fahrenheit)/second and 4.0° C. (39.2 degree Fahrenheit)/second. from approximately 1600° F. (871° C.) to 400° F. (204.4° C.). At step 1030, the UTS and YS values for the part are increased and the increases correspond to the cooling rate. This results in about a 5% or better increase in the UTS and YS with having to use a premium material and potentially allows for larger static margins in the design, and larger rework allowance potential for the part.

While the principles of this disclosure have been shown in various exemplary embodiments, many modifications of structure, arrangements, proportions, the elements, materials, and components, used in practice, which are particularly adapted for a specific environment and operating requirements, may be used without departing from the principles and scope of this disclosure. These and other changes or modifications are intended to be included within the scope of the present disclosure and may be expressed in the following claims.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit advantage, or solution to occur or become more pronounced are not to be construed as critical, required, or essential features or elements of any embodiment. In the claims, reference to an element in the singular is not intended to mean "one and only one" unless explicitly so stated, but rather "one or more."

Moreover, when language similar to "at least one of A, B, or C" or "at least one of A, B, and C" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C. The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

Systems, methods, and apparatus are provided herein. In the detailed description herein, references to "various exemplary embodiments," "one embodiment", "an embodiment", "an exemplary embodiment", etc. indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises," "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. The present disclosure generally relates to control applications for vehicles and more specifically to systems, apparatuses, and methods for aircraft brake control systems of at least an un-commanded brake application to one or more wheels during takeoff.

Numbers, percentages, or other values stated herein are intended to include that value, and also other values that are about or approximately equal to the stated value, as would be appreciated by one of ordinary skill in the art encompassed by various embodiments of the present disclosure. A stated value should therefore be interpreted broadly enough to encompass values that are at least close enough to the stated value to perform a desired function or achieve a desired result. The stated values include at least the variation to be expected in a suitable industrial process, and may include values that are within 10%, within 5%, within 1%, within 0.1%, or within 0.01% of a stated value. Additionally, the terms "substantially," "about" or "approximately" as used herein represent an amount close to the stated amount that still performs a desired function or achieves a desired result. For example, the term "substantially," "about" or "approximately" may refer to an amount that is within 10% of, within 5% of, within 1% of, within 0.1% of, and within 0.01% of a stated amount or value.

Furthermore, no element, component, or method step in the present disclosure is intended to be dedicated to the public regardless of whether the element, component, or method step is explicitly recited in the claims. No claim element herein is to be construed under the provisions of 35 U.S.C. 312(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, it should be understood that any of the above-described concepts can be used alone or in combination with any or all of the other above-described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible in light of the above teaching.

What is claimed is:

1. A method of implementing a heat treatment process for enhancing strength of a part, comprising:

controlling, by a controller, a set of parameters that adjusts a cooling rate for a gas quenching process to enable a controlled operation for cooling the part from a critical temperature maintained for a period of time, wherein the part comprises a steel material comprising at least one of a 300M steel material or a 4330V steel material, the controlled operation for cooling the part is a subsequent action in the heat treatment process applied after the steel material of the part has been determined to have reached the critical temperature based on part thickness;

controlling, by the controller, the cooling of the steel material of the part in the gas quenching process by affecting of changes in the cooling rate over one or more increments of time for the cooling of the part that results in an increase in value of an Ultimate Tensile Strength (UTS) of the steel material;

controlling, by the controller, the cooling rate to be between 1.0° C./second and 4.0° C./second over the one or more increments of time; and constraining the part with a holding device during the gas quenching process so as to further increase a value of either the UTS or a Yield Strength (YS) of the steel material.

2. The method of claim 1, wherein the controlled cooling in the gas quenching process of the part affected by changes in a cooling rate results in the increase in value of the YS of the steel material.

3. The method of claim 2, further comprising:

performing an oil quenching process on the part to cool the part from a first temperature to a second temperature at a first cooling rate; and performing the gas quenching process on the part with the controlled cooling to cool the part from the second temperature to a third temperature at a second cooling rate, and the second cooling rate is slower than the first cooling rate.

4. The method of claim 1, wherein the steel material comprises the 300M steel material.

5. The method of claim 4, wherein for the 300M steel material, the value of the UTS increases in a range from approximately 280 ksi to 290 ksi.

6. The method of claim 4, wherein for the 300M steel material, the value of the YS increases in a range from approximately 230 ksi to 240 ksi.

7. The method of claim 1, wherein the steel material comprises the 4330V steel material.

8. The method of claim 7, wherein for the 4330V steel material, the value of the UTS increases in a range from approximately 220 ksi to 230 ksi.

9. The method of claim 7, wherein for the 4330V steel material, the value of the YS increases in a range from approximately 185 ksi to 195 ksi.

10. The method of claim 1, wherein the critical temperature is about 1600° F.

* * * * *